US006771301B1

(12) United States Patent
Askins

(10) Patent No.: US 6,771,301 B1
(45) Date of Patent: Aug. 3, 2004

(54) IMAGE SETTING APPARATUS HAVING DRUM SIMULATING SUPPORTS

(75) Inventor: Paul Askins, Rochester, NY (US)

(73) Assignee: A.B. Dick Company, Niles, IL (US)

( * ) Notice: Subject to any disclaimer, the term of this patent is extended or adjusted under 35 U.S.C. 154(b) by 0 days.

(21) Appl. No.: 10/385,146

(22) Filed: Mar. 10, 2003

(51) Int. Cl.[7] ..... B41J 13/10; B41J 13/00
(52) U.S. Cl. ..... 347/262; 347/264
(58) Field of Search ..... 347/262, 264, 347/101, 104, 218

(56) References Cited

U.S. PATENT DOCUMENTS

| | | | | |
|---|---|---|---|---|
| 3,025,778 A | | 3/1962 | Stuckens | |
| 3,875,587 A | | 4/1975 | Pugsley | |
| 4,334,770 A | | 6/1982 | Landsman | |
| 4,475,787 A | | 10/1984 | Starkweather | |
| 4,684,228 A | | 8/1987 | Holthusen | |
| 4,698,647 A | | 10/1987 | Gerlach | |
| 4,712,896 A | | 12/1987 | Holthusen | |
| 4,803,497 A | | 2/1988 | Kennedy, Jr. et al. | |
| 4,853,709 A | | 8/1989 | Stein et al. | |
| 5,404,187 A | | 4/1995 | Sterflinger | |
| 5,579,115 A | | 11/1996 | Stein et al. | |
| 5,589,900 A | | 12/1996 | Sterflinger | |
| 5,828,399 A | | 10/1998 | Van Aken et al. | |
| 5,969,742 A | * | 10/1999 | Knox et al. | 347/262 |
| 6,097,475 A | | 8/2000 | Jakul et al. | |
| 6,240,260 B1 | * | 5/2001 | Krupica et al. | 347/262 |
| 6,342,914 B1 | * | 1/2002 | Johnson et al. | 347/262 |

* cited by examiner

*Primary Examiner*—Huan Tran
(74) *Attorney, Agent, or Firm*—Pearne & Gordon LLP

(57) ABSTRACT

An image setting apparatus produces an image on a flexible section of imageable material. The apparatus includes a retainer for retaining the flexible section in a cylindrical configuration about a cylinder axis. An imageable surface of the section faces inwardly toward the axis. The apparatus includes an imaging source for selectively exposing the inwardly-facing imageable surface to produce the image. The retainer includes a plurality of arced supports spaced from each other along the axis. Each support has a curved surface segment for physical contact with an outwardly-facing surface of the section.

17 Claims, 4 Drawing Sheets

IMAGE SETTING APPARATUS HAVING DRUM SIMULATING SUPPORTS

FIELD OF THE INVENTION

The present invention relates to the art of producing an image on an imageable surface of a flexible material while the material is held in a cylindrical shape. The present invention specifically relates to an image setting apparatus that retains the material in the cylindrical shape without the use of a conventional full drum.

BACKGROUND OF THE INVENTION

Within the image setting art, it is known to utilize a hollow interior drum device for the production of an image onto an imageable material. This is commonly referred to as internal drum technology. The drum device has a portion that extends along and about a cylinder axis. The portion is continuous along the cylinder axis, but is open at one segment about the cylinder axis to provide a general "C" shape when viewed along the cylinder axis. Imageable material (e.g., photosensitive film or paper) is located inside of the drum device such that the material presses against an inner, cylindrical surface of the drum device. A firm contact against the inner surface is often accomplished via the use of a vacuum system operatively connected to perforations extending to the inner surface. Additionally, various means are also used to counter friction between the drum inner surface and the flexible media. This friction interferes with accurate positioning of the flexible media within the drum inner surface.

A device for exposing the imageable material is located at least partially within the interior of the drum device. For example, the exposing device includes a laser and a rotating reflective member (e.g., a mirror or prism). Light from the laser is directed along the cylinder axis and impinges upon the reflective member, which is rotating on the cylinder axis. The light is redirected onto the imageable material via the reflective member. Rotation of the reflective member provides for a scan across the imageable material and axial movement of the reflective member provides for progression of the scan along the axial extent of the imageable material.

In order to produce a good image, the cylindrical surface must be manufactured to have minimal deviation from an ideal cylinder shape. Manufacture of a unitary drum device that has such a desirous cylindrical surface is difficult and expensive. For example, manufacturing requires a high degree of precise machining accuracy over the entire inner surface. Also, the drum device has a fixed size and tends to be relatively heavy.

It is also known within the image setting art to utilize two or more circular rings or disks to provide for an internal imaging set-up. Specifically, imageable material is tensioned around the plurality of rings to form a virtual internal imaging drum (i.e., the flexible material is held in a cylindrical state). As with the conventional internal drum technology, an inner surface of the imageable material is exposed via the use of a translational/rotational reflective member (e.g., a moving prism or mirror) while the material is in the cylindrical state. However, a certain amount of ring contact with the inwardly-facing imageable surface of the imageable material is necessary. As such, a certain amount of the imageable material is unusable and thus wasted. Also, in one embodiment of such a virtual imaging arrangement, a ring or disk is axially moved along the imageable material while the reflective member is axially moved. However, such a moving ring may cause abrasion against the imageable material.

SUMMARY OF THE INVENTION

In accordance with one aspect, the present invention provides an image setting apparatus for producing an image on a flexible section of imageable material. The apparatus includes retainer means for retaining the flexible section in a cylindrical configuration about a cylinder axis, with an imageable surface of the section facing inwardly toward the axis. The apparatus includes means for selectively exposing the inwardly-facing imageable surface to produce the image. The retainer means included a plurality of arced supports spaced from each other along the axis. Each support has a curved surface segment for physical contact with an outwardly-facing surface of the section.

BRIEF DESCRIPTION OF THE DRAWINGS

The foregoing and other features and advantages of the present invention will become apparent to those skilled in the art to which the present invention relates upon reading the following description with reference to the accompanying drawings, wherein.

DESCRIPTION OF EXAMPLE EMBODIMENTS

Figure 1:
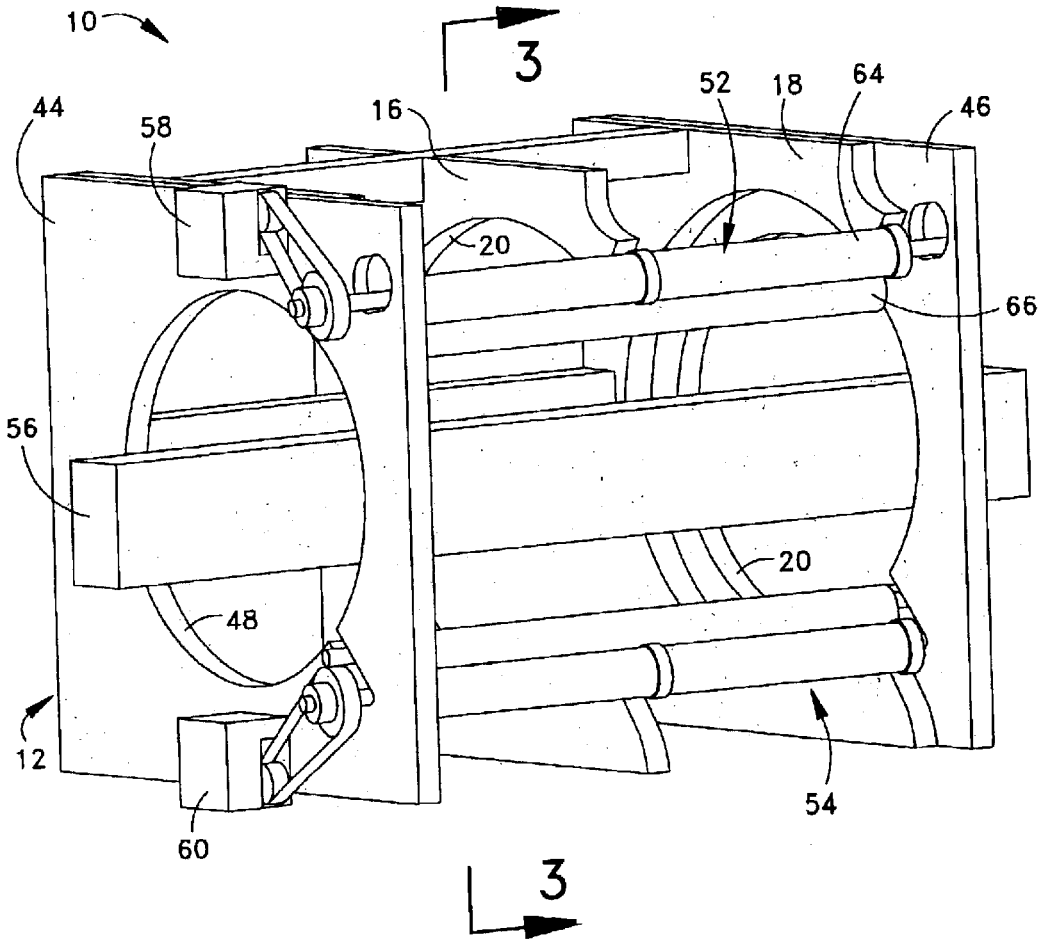
FIG. 1 is a perspective view of an example image setting apparatus in accordance with the present invention, with certain parts not shown.
Figure 2:
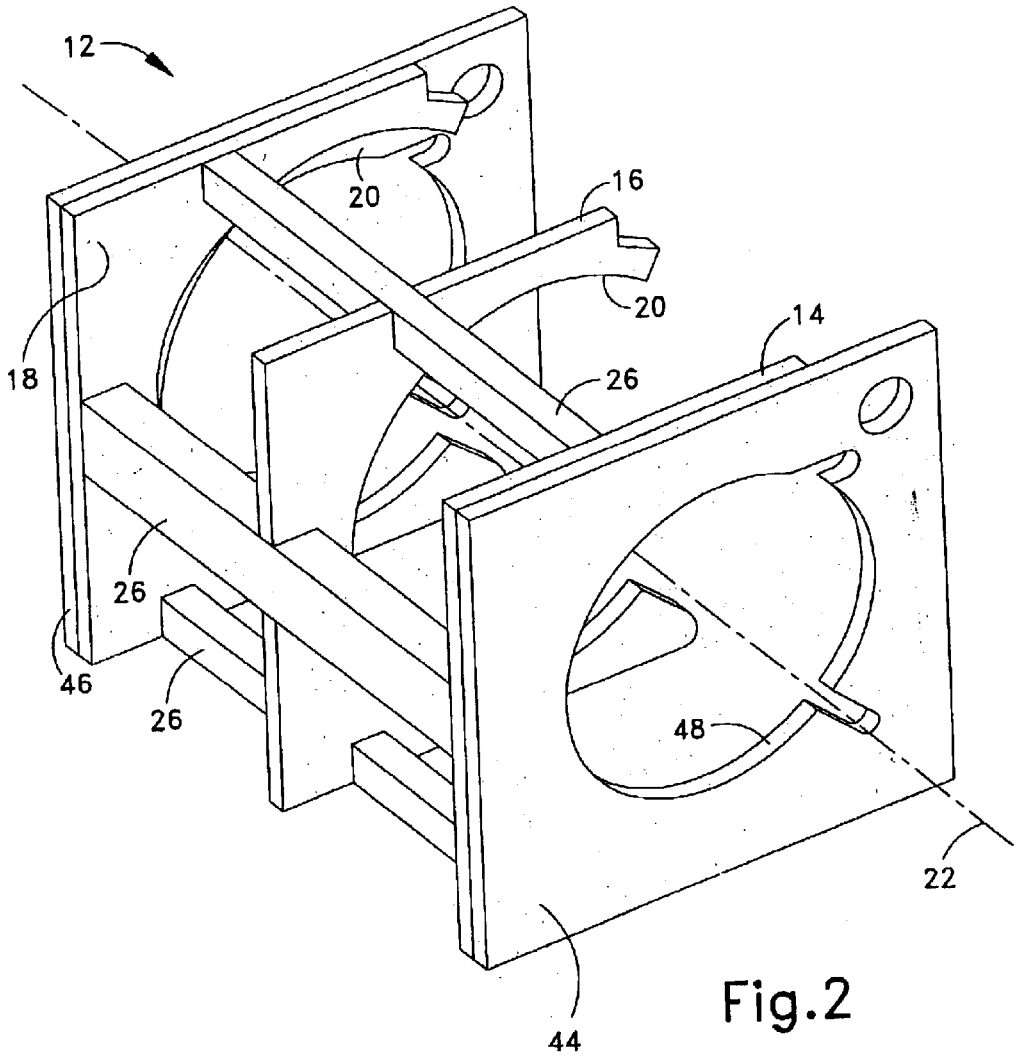
FIG. 2 is a reverse angle perspective of a simulated drum retainer of the example image setting apparatus of in FIG. 1.
Figure 3:
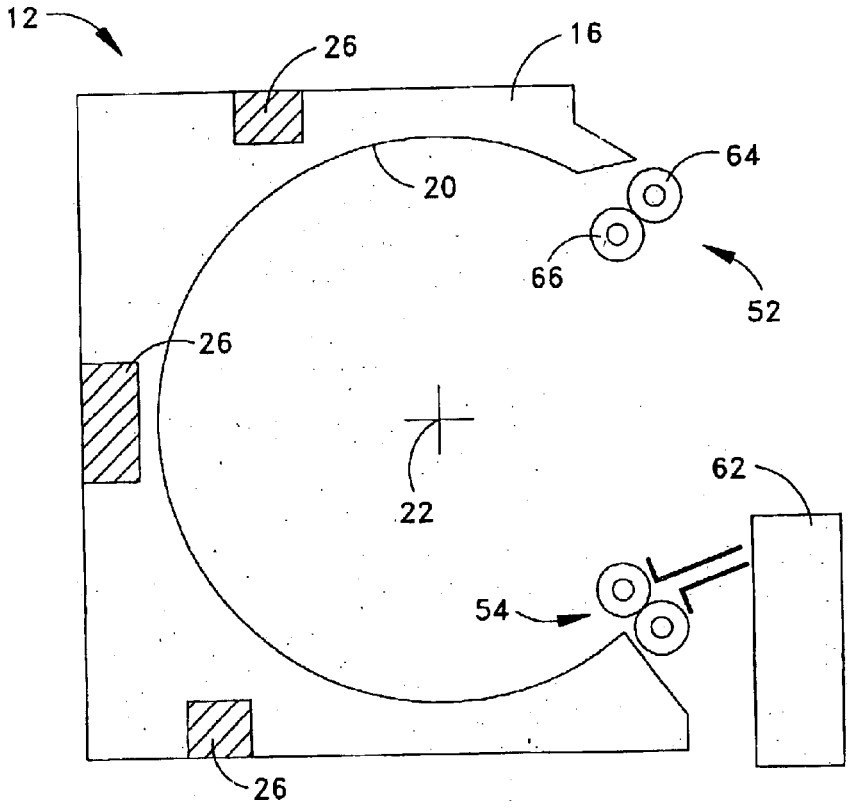
FIG. 3 is a view taken along line 3—3 of FIG. 1, with certain parts not shown.

An example of an image setting apparatus 10 in accordance with the present invention is shown in FIG. 1. The apparatus 10 includes a simulated drum retainer 12 (FIG. 2) that has a first side support 14, a center support 16, and a second side support 18. Each support (e.g., the center support 16, see FIG. 3) has a general C-shaped configuration with a smooth circular surface segment 20 facing inwardly toward a center axis 22. The surface segments 20 of the three supports 14–18 (FIG. 2) are all at the same radius from the center axis 22. In the shown example, the circular surface segment 20 of each support (e.g., the center support 16, see FIG. 3) does not completely extend about the center axis 22. Instead, the surface segment 20 provides an arc (i.e., a partial circle) about the center axis 22. As such, the supports 14–18 are arced supports with curved surface segments. In one example, the surface segment 20 extends approximately 250° about the center axis 22. However, it is to be appreciated that a different arc extent (i.e., different from 250°) of the surface segment 20 about the axis 22 is possible.

The three supports 14–18 (FIG. 2) are spaced from each other along the center axis 22. A plurality (e.g., three) of cross members 26 extend between the first side support 14, the center support 16, and the second side support 18 for holding the supports relative to each other. As such, the supports 14–18 are fixed relative to each other and are fixed to maintain their inwardly-facing surface segments 20 at a radial and longitudinal position relative to the center axis 22.

Figure 4:
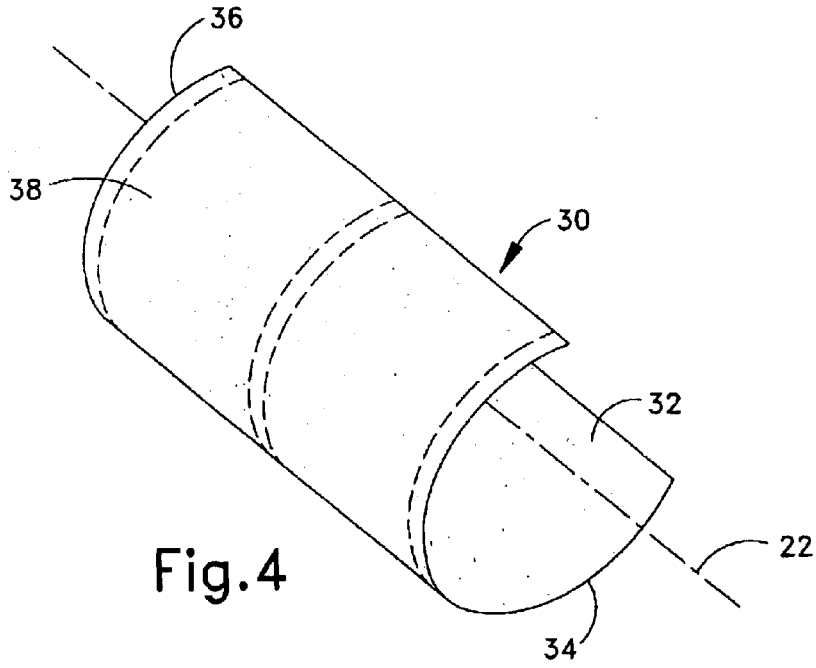
FIG. 4 is a perspective view of a flexible section of imageable material formed into a cylindrical shape, as by the simulated drum retainer of FIG. 2, with contact locations with the simulated drum retainer shown in phantom.

The simulated drum retainer 12 (FIG. 2) provides for retaining a flexible section of an imageable material 30 (FIG. 4) in a cylindrical configuration about the center axis 22. The term "cylindrical" is intended to have a broad meaning, and is to include all cylindraceous configurations (such as a configuration that does not extend completely around the center axis 22 and as shown in the example of FIG. 4). The term "cylindrical" is used herein with for ease of discussion, but with the aforementioned understanding.

The imageable material 30 has an imageable surface 32 that faces inwardly toward the center axis 22 when the material is in the cylindrical configuration. As such, the three supports 14–18 (FIG. 2) provide a simulated internal drum, and the center axis 22 is a cylinder axis. The first side support 14 is located to be adjacent to a first axial end 34 of the section of material, the second side support 18 is located to be adjacent to a second axial end 36 of the section of material, and the center support 16 is located to be adjacent to the mid-portion of the section of material. The three supports 14–18 physically contact the outwardly facing surface 38 of the section of material 30, as is represented by the phantom-dash lines shown in FIG. 4. The three supports 14–18 provide for minimal contact against the imageable material 30 (FIG. 4). It is to be appreciated that a different number of supports (e.g., five) could be provided within the simulated drum retainer.

The first and second side supports 14 and 18 are each respectively connected to first and second side plates 44, 46. Each side plate (e.g., 44) has an opening 48, which is generally circular. In the shown example, the openings 48 are concentric with the circle bounded by the surface segment of the associated side support (e.g., 14). The radius of the opening 48 of each side plate (e.g., 44) is less than the radius of the surface segment 20 of the associated side support (e.g., 14). Accordingly. The side plates 44, 46 provide axial ends for the simulated drum.

Turning again to the overall image setting apparatus 10 (see FIGS. 1 and 3), the apparatus includes any additional, suitable structure for handling and imaging of the imageable material 30. In the illustrated example, such structure includes an upper roller pair 52, a lower roller pair 54, and a linear/rotational imaging source 56 (schematically shown as an elongate block in FIG. 1). Further, such structure may include upper and lower drive mechanisms 58, 60 for operating the upper and lower roller pairs 52, 54, respectively, and may also include an arrangement 62 (see FIG. 3) for cutting the imageable material, from a bulk supply, to provide the flexible section of the material 30 that is held in the cylindrical configuration.

In order to appreciated the structures that are shown in the various Figures, it should be noted that the arrangement 62 for cutting is not shown in FIG. 1. Further, the linear/rotational imaging source 56 is not shown in FIG. 3. Also, the second side plate is not shown in FIG. 3.

Within the shown example of FIG. 1, the upper and lower roller pairs 52, 54 have some similar features, and the upper and lower drive mechanisms 58, 60 have some similar features. As such, only the upper roller pair 52 and the associated upper drive mechanism 58 are discussed, with the understanding that the discussion is generally applicable to the lower roller pair 54 and associated lower drive mechanism 60. The upper roller pair 52 is located adjacent to one edge (i.e., upper) of a mouth of the general C-shape of the supports 14–18. For the upper roller pair 52, a first roller 64 extends parallel to the center axis 22, and a second roller 66 extends parallel to the center axis adjacent to the first roller. The roller 64, 66 are supported for rotation on the first and second side plates 44, 46. The first and second rollers 64, 66 provide a nip there between. Upon rotation of the rollers 64, 66, the imageable material is moved though the nip relative to the simulated drum retainer 12 (i.e., through the mouth of the C-shape of the support members). This movement is provided by the upper drive mechanism 58 which is operatively connected (e.g., via a belt drive and pulley arrangement) to at least one of the first and second rollers 64, 66. With the material within the simulated drum retainer 12 and the rollers 64, 66 stationary, the roller pair 52 also provides for holding the imageable material within the supports and pressed against the supports 14–18.

Figure 5:
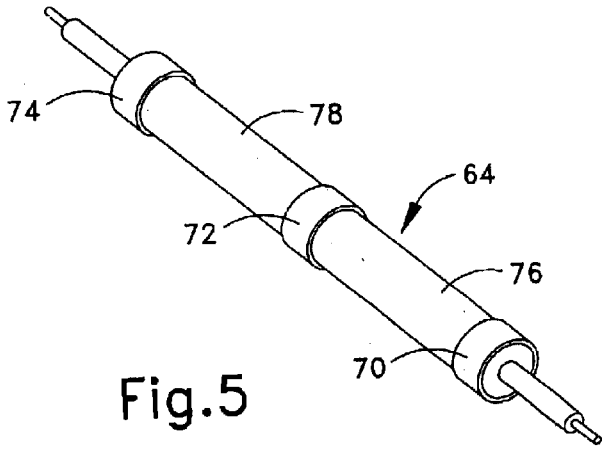
FIG. 5 is a perspective view of a roller of the example image setting apparatus of FIG. 1.

It is to be noted that in the shown example, the first roller 64 has a plurality (e.g., three) of raised segments 70–74 (see FIG. 5). The raised segments 70–74 are generally located adjacent to the first side support 14, the center support 16, and the second side support 18. In one example, the raised segments 70–74 have a 0.025 inch greater diameter than other portions 76, 78 of the roller 64. The greater diameter provides for a greater or heavier contact at the raised segments 70–74 against the imageable material 30 that is being passed through the nip of the roller pair 52. Lighter contact occurs at the other, non-raised portions 76, 78 of the roller 64. As such, the heavier contact transmits a majority of the force from the roller pair 52 to the material 30. This provides for a minimization of bending of the imageable material 30 between the three supports 14–18 (i.e., the first side support, the center support, and the second side support). As such, the imageable material 30 that is placed into and held within the simulated drum retainer 12 undergoes a minimized amount of distortion from a perfect cylindrical shape.

The preceding overall image setting apparatus is intended for use with a continuous roll of flexible imageable material. A useful variant of this apparatus can be produced for use with separate, fixed length sheets of flexible imageable material. This variant would include one roller assembly with a plurality of raised segments as previously described. This roller assembly would be used to feed the flexible imageable sheets into one end of the image setting apparatus. At the opposite end of the image setting apparatus a fixed mechanical stop would locate the inserted end of the flexible imageable sheet around the image setting circumference. The roller assembly would press the flexible imageable sheet into this stop, forcing the sheet against the cylindrical rings. A second face on that stop, located tangentially to the cylindrical ring surface, would prevent the stopped edge of the flexible imageable sheet from bowing outward between the plurality of cylindrical rings.

An additional variant of the image setting apparatus can be produced for use with a range of lengths of cut sheets of flexible imageable material. In this variant the fixed mechanical stop may be made such that it is adjustable to a range of circumferential positions around the cylindrical rings.

Turning to the linear/rotational imaging source 56 which is schematically shown as only a block, the imaging source provides the function of selective imaging of the imageable material 30 and as such it is to be appreciated that any suitable construction and configuration of such a source is possible. Many imaging sources that provide such function are known. Accordingly, the construction and configuration of the imaging source does not limitation of the present invention. In one specific example, such an imaging source 56 includes a liner transfer bar that extends along the center axis 22 within the simulated retainer drum 12 and within the cylinder of the imageable material 30 that is held within the simulated retainer drum. A rotational reflecting member (e.g., a mirror or prism) is moveable along the bar during rotation of the mirror relative of the center axis. An exposing energy source (e.g., a laser) directs an exposing energy (e.g., a laser light) along the axis to impinge upon the rotational reflecting member.

The reflecting member redirects the exposing energy onto the imageable material to cause image creation on the imageable material. The reflecting member is rotated about the center axis 22 such that the energy is swept within a circle of the cylindrical shape of the imageable material for each axial position of the mirror. The reflecting member is also moved along the axis to access each respective circular trace within the cylindrical shape of the imageable material along the center axis 22. The energy is modulated, or the like, to provide for creation of the image during the movement (e.g., rotational and linear) of the reflecting member.

The arrangement 62 (see FIG. 3) for cutting the imageable material from a bulk supply may have any construction and configuration. For example, the cutter may have a blade that is moved against and relative to the material once the material is within the simulated drum retainer.

Figure 6:
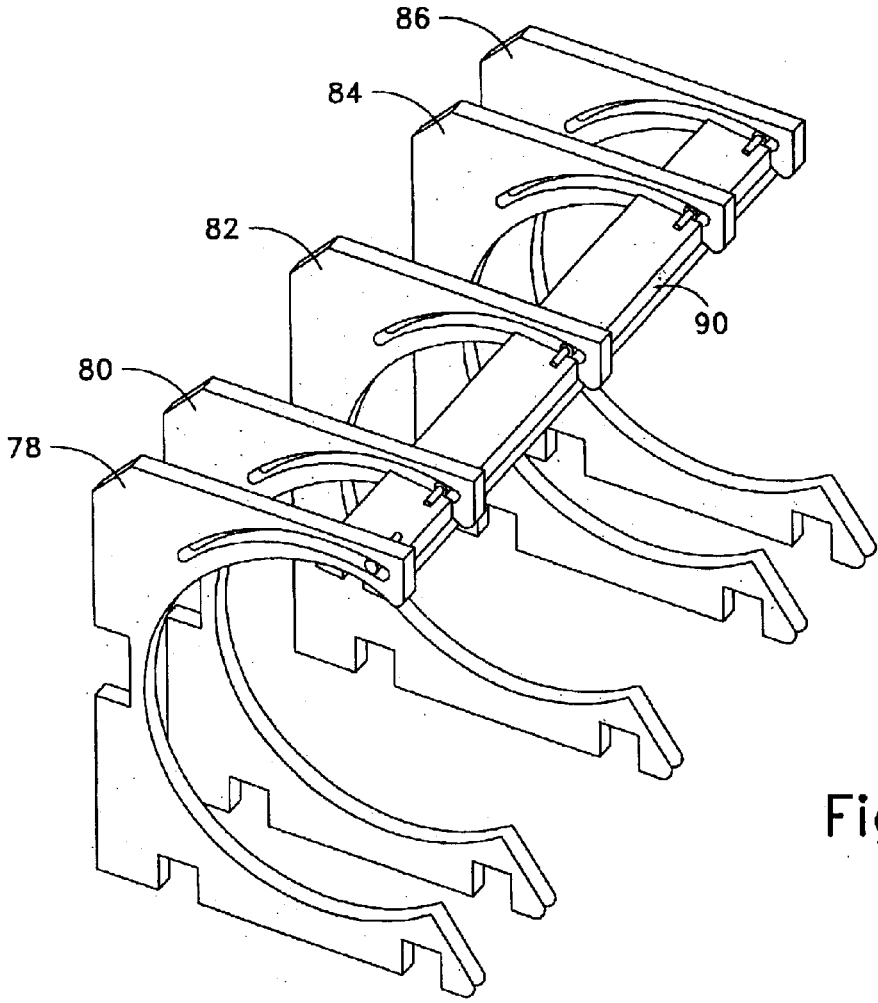
FIG. 6 is a perspective view of a modified portion of an image setting apparatus.

FIG. 6 shows an example of a portion of an image setting apparatus that utilizes five supports 78–86, rather than just three supports, as is shown in the previous example. Also, FIG. 6 illustrates a mechanical stop 90. Such an arrangement is configured for use with precut sheets (not shown), rather than a sheet that is cut from a continuous source. As such, each sheet is fed from the bottom and is moved to abut against the stop 90 located near the top. The mechanical stop 90 may be fixed in place or may be movable relative to the supports. The stop 90 would be positioned along the circumference of the supports 78–86 such that the inserted end of the sheet would be stopped, and the sheet pressed against the supports, just as the tail end of the sheet reached a lower roller nip (not shown).

Figure 7:
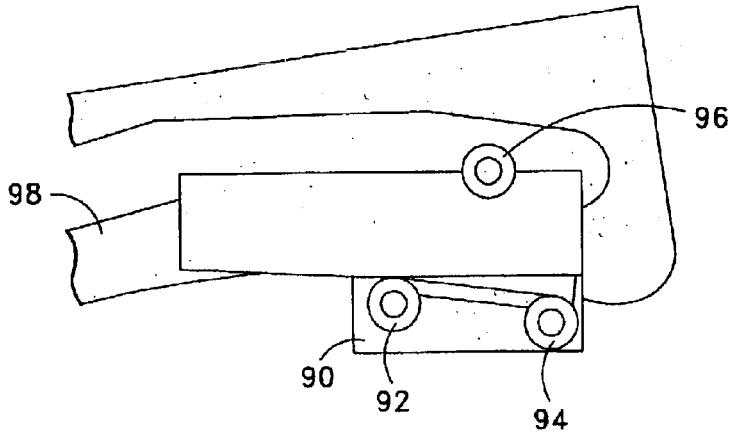
FIG. 7 is a schematized side view of a modified portion of an image setting apparatus.

FIG. 7 is a schematized view that shows details of the example movable mechanical stop 90. Specifically, two guide rollers 92, 94 allow the stop 90 to move along the drum ring surface. A third (upper, as viewed in FIG. 7) roller 96 is spring loaded against a second, less accurately machined cylindrical surface 98 machined into the drum rings to force the lower rollers 92, 94 against the respective cylindrical surface of the support.

It is to be appreciated that the present invention reduces friction between the media and the surfaces that provide the virtual drum. Also, the use of the supports prevents the trapping of air between the media and the drum. Still further, it should be appreciated the supports do not touch the imagable side of the media. Even further, the media is formed into the viable cylinder shape without the use of a complete cylinder holder.

From the above description of the invention, those skilled in the art will perceive improvements, changes and modifications. Such improvements, changes and modifications within the skill the of the art are intended to be covered by the appended claims.

What is claimed is:

1. An image setting apparatus for producing an image on a flexible section of imageable material, the apparatus including:

retainer means for retaining the flexible section in a cylindrical configuration about a cylinder axis, with an imageable surface of the section facing inwardly toward the axis;

means to support said retainer means in a fixed position; and means for selectively exposing the inwardly-facing imageable surface to produce the image;

the retainer means including a plurality of arced supports spaced from each other along the axis, and each support having a curved surface segment for physical contact with an outwardly-facing surface of the section.

2. An apparatus as set forth in claim 1, wherein the plurality of supports includes three supports, a first of the supports is located to be adjacent to a first axial end of the section, a second of the supports is located to be adjacent to a second axial end of the section, a third of the supports is located axially between the first and second supports.

3. An apparatus as set forth in claim 1, wherein the plurality of supports includes five supports, a first of the supports is located to be adjacent to a first axial end of the section, a second of the supports is located to be adjacent to a second axial end of the section, and third-fifth supports are located axially between the first and second supports in a spaced relationship.

4. An apparatus as set forth in claim 1, wherein at least one support has a general C-shape, with a mouth of the C-shape permitting entrance of the section into the C-shape.

5. An apparatus as set forth in claim 4, wherein the C-shaped support is located to be adjacent to a mid-portion of the section.

6. An apparatus as set forth in claim 4, wherein the C-shaped support is located to be adjacent to an axial end of the section, the C-shaped support is mounted on a support that includes a surface that extends transverse to the axis at a location that is to be adjacent to an axial end of the section.

7. An apparatus as set forth in claim 1, including means for holding the section in engagement with the supports.

8. An apparatus as set forth in claim 7, wherein the means for holding includes a roller assembly.

9. An apparatus as set forth in claim 8, wherein the roller assembly includes two rollers that provide a nip through which the section passes.

10. An apparatus as set forth in claim 9, wherein each roller has a generally cylindrical outer surface.

11. An apparatus as set forth in claim 10, wherein at least one of the rollers has a raised surface portion on the generally cylindrical outer surface.

12. An apparatus as set forth in claim 7, wherein the means for holding includes two roller assemblies.

13. An apparatus as set forth in claim 7, wherein the means for holding includes one roller assembly and one stationary mechanical stop.

14. An apparatus as set forth in claim 7, wherein the means for holding includes one roller assembly and one mechanical stop, the stop being adjustable about the ring circumference.

15. An apparatus according to claim 1 wherein said means to support said retainer means are first and second side plates.

16. An apparatus according to claim 15 wherein said side plates have openings therein which are generally circular.

17. An apparatus according to claim 16 wherein said openings are concentric with circles bounded by the surface segments of an end pair of said arched supports and wherein said openings have radii which are less than radii of said circles to provide axial ends for said flexible section.

* * * * *